US005309660A

United States Patent [19]

Blackamore

[11] Patent Number: 5,309,660

[45] Date of Patent: May 10, 1994

[54] CARTRIDGE MAGAZINE

[76] Inventor: James D. Blackamore, 25961 Pasofino, Laguna Niguel, Calif. 92677

[21] Appl. No.: 976,954

[22] Filed: Nov. 16, 1992

[51] Int. Cl.[5] ..... F41A 9/67

[52] U.S. Cl. ..... 42/50; 42/87; 42/106

[58] Field of Search ..... 42/1.01, 49.01, 50, 42/87, 88, 90, 106; 89/1.25

[56] References Cited

U.S. PATENT DOCUMENTS

| | | | |
|---|---|---|---|
| 1,245,499 | 11/1917 | Orme | 42/50 |
| 1,370,617 | 3/1921 | Thompson | 42/50 |
| 3,758,978 | 9/1973 | Theodore | 42/50 |
| 5,129,173 | 7/1992 | Kuykendall | 42/90 |

FOREIGN PATENT DOCUMENTS

| | | | |
|---|---|---|---|
| 111381 | 8/1925 | Switzerland | 42/88 |

OTHER PUBLICATIONS

Smith, et al., Small Arms & Cannons, 1982, pp. 23, 113.

*Primary Examiner*—Stephen C. Bentley
*Attorney, Agent, or Firm*—S. Michael Bender

[57] ABSTRACT

A cartridge magazine for firearms comprises a key insertable through a slot in the end panel of the magazine for engaging the spring engaged elevator upon which the shells are supported. The slot includes a series of transverse or lateral branches spaced longitudinally on the panel for receiving the key and locking the elevator in position. The magazine thus may be loaded with cartridge shells in stages as defined by the lateral locking branches. After loading is completed, the key may be removed from the magazine and clip so that the latter may be inserted into the firearm with which it is used. In an alternatively preferred embodiment, optional marking means are positioned on top of the magazine for placing an identifying marking on each cartridge shell.

8 Claims, 4 Drawing Sheets

CARTRIDGE MAGAZINE

BACKGROUND OF THE INVENTION

1. Field of the Invention

The present invention relates generally to cartridge magazines for firearms, and more particularly, to a cartridge magazine having means for facilitating the easy and rapid loading of cartridge shells therein.

2. Description of the Prior Art

The conventional method of loading cartridge shells or bullets into the magazine or clip of a firearm comprises the progressive compression of the magazine's spring and the insertion of one bullet at a time against the increasing spring resistance. Usually the bullet being loaded is pressed against the previously loaded bullet requiring considerable dexterity and force. Unaided, the loading of a magazine in the prescribed manner, is difficult, time consuming, and may lead to misalignment problems and consequent jamming of the bullets in the loaded clip. In order to overcome the foregoing problems in loading cartridges into a magazine, various mechanical appliances have been proposed. For example in U.S. Pat. No. 4,827,651 there is disclosed a loading aid for facilitating the insertion of bullets in a magazine one at a time by exerting finger pressure on the ledge of the device fitted over the top of the magazine. While this prior art device helps to make the loading process somewhat easier, a separate mechanical device is required and the problem of loading subsequent bullets against increasing spring resistance still is not overcome. A need exists therefore, for an improved cartridge magazine which overcomes the problems of the prior art by facilitating the loading of the magazine without requiring external mechanical aids or attachments and which overcomes the problems occasioned by the progressive resistance of the magazine spring.

The foregoing need is met by the cartridge magazine of the present invention as will be made apparent from the following description thereof. Other advantages of the present invention over the prior art also will be rendered evident.

SUMMARY OF THE INVENTION

To achieve the foregoing and other advantages, the present invention, briefly described, provides a cartridge magazine for firearms comprises a key insertable through a slot in the end panel of the magazine for engaging the spring engaged elevator upon which the shells are supported. The slot includes a series of transverse or lateral branches spaced longitudinally on the panel for receiving the key and locking the elevator in position. The magazine thus may be loaded with cartridge shells in stages as defined by the lateral locking branches. After loading is completed, the key may be removed from the magazine and clip so that the latter may be inserted into the firearm with which it is used. In an alternatively preferred embodiment, optional marking means are positioned on top of the magazine for placing an identifying marking on each cartridge shell.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining at least two preferred embodiments of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved cartridge magazine which has all of the advantages of the prior art and none of the disadvantages.

It is another object of the present invention to provide a new and improved cartridge magazine which may be easily and efficiently manufactured and marketed.

It is a further objective of the present invention to provide a new and improved cartridge magazine which is of durable and reliable construction.

Still yet a further object of the present invention is to provide a new and improved cartridge magazine capable of facilitating the loading of shells therein in a simple and rapid manner.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein.

DESCRIPTION OF THE PREFERRED EMBODIMENT

With reference now to the drawings, a new and improved cartridge magazine embodying the principles and concepts of the present invention will be described.

Figure 1:
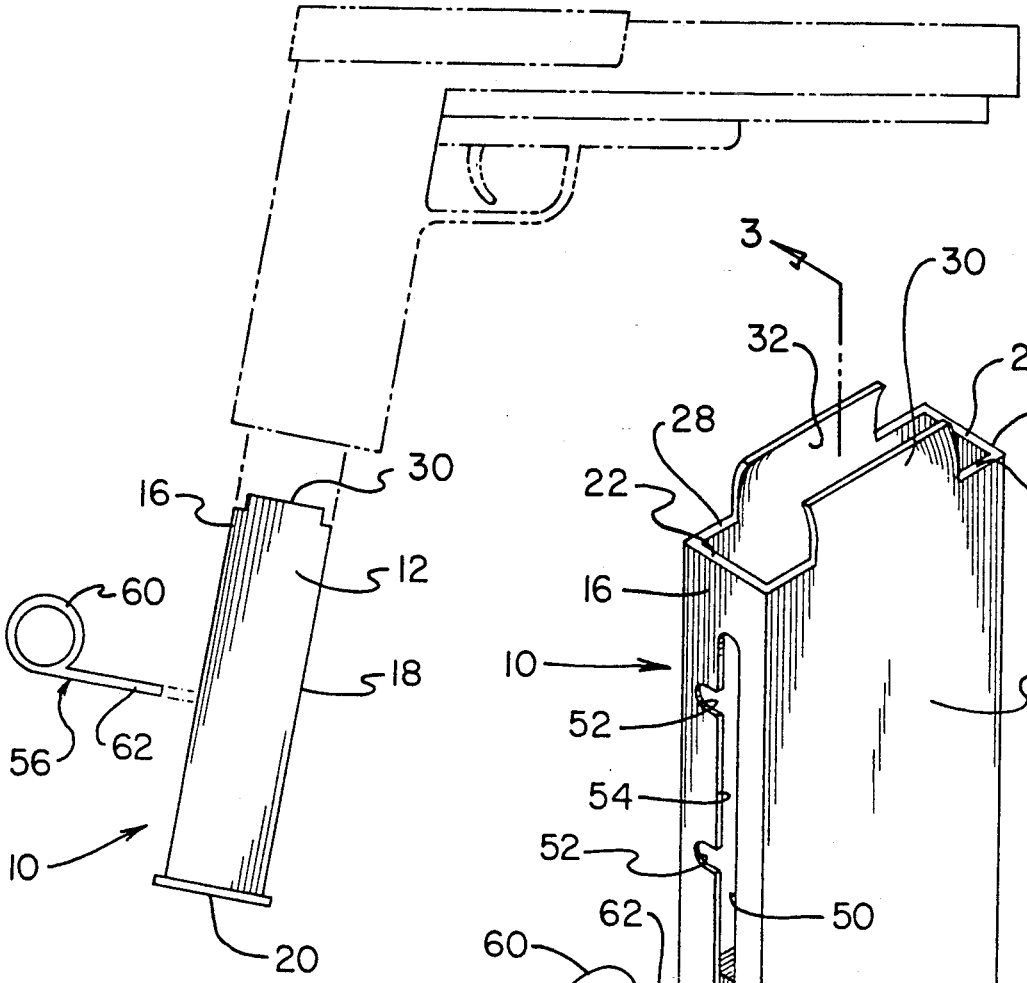
FIG. 1 is an elevational front view of the first preferred embodiment of the cartridge magazine of the invention.
Figure 2:
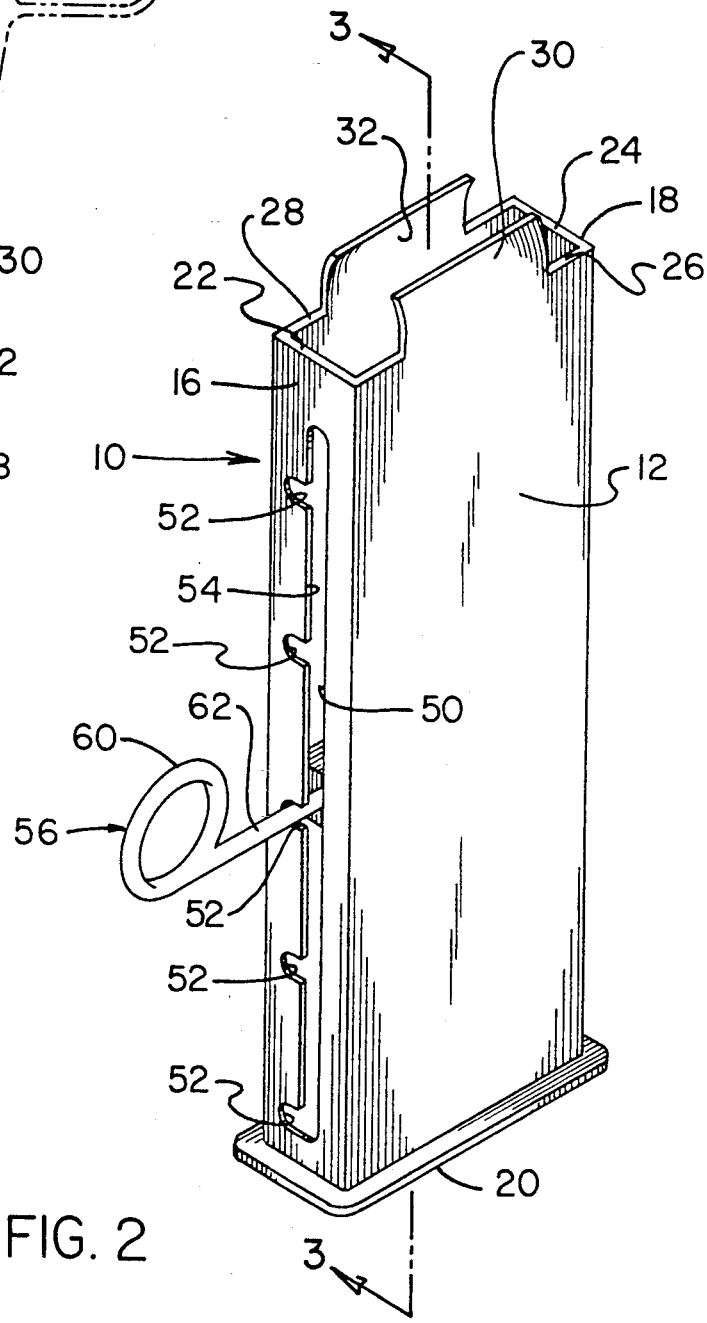
FIG. 2 is an elevational view in prospective of the first preferred embodiment of the cartridge magazine of the invention.
Figure 3:
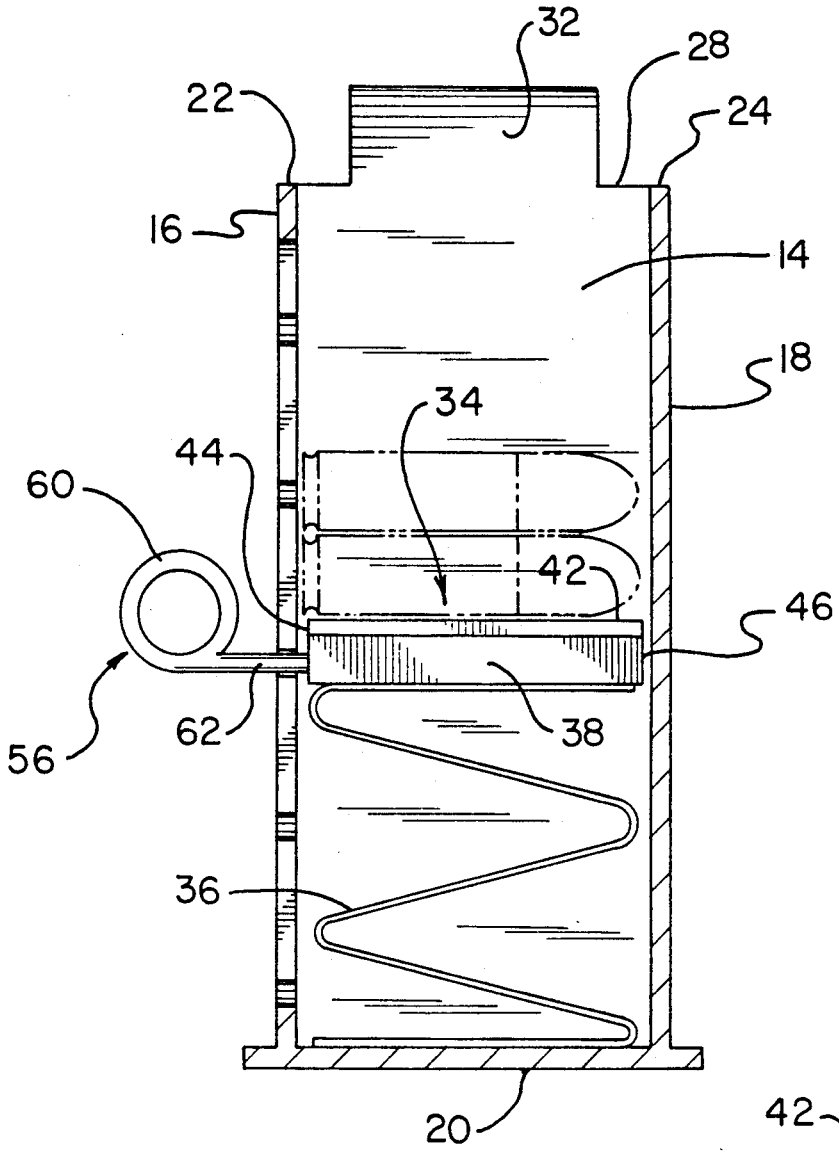
FIG. 3 is a cross-sectional view of the embodiment of the cartridge magazine shown in FIGS. 1 and 2 taken along line 3—3 of FIG. 2.
Figure 4:
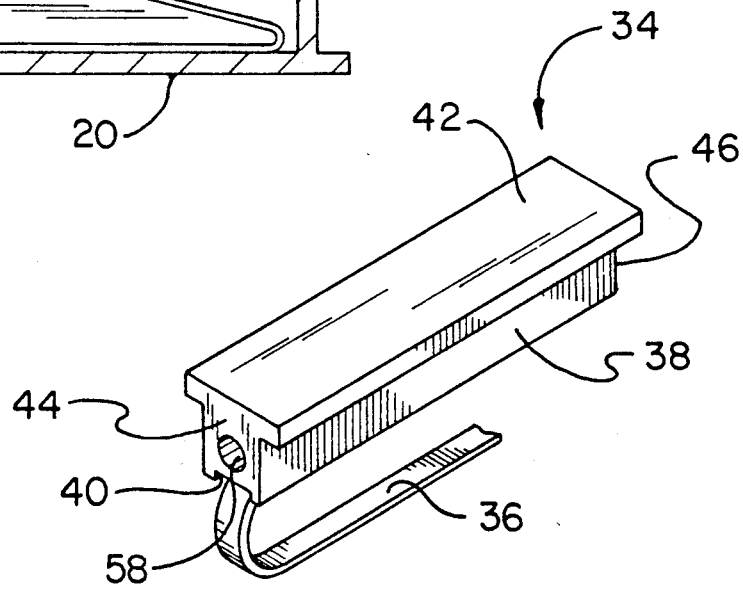
FIG. 4 is detail in perspective of the elevator portion of the invention shown in FIGS. 1–3.
Figure 7:
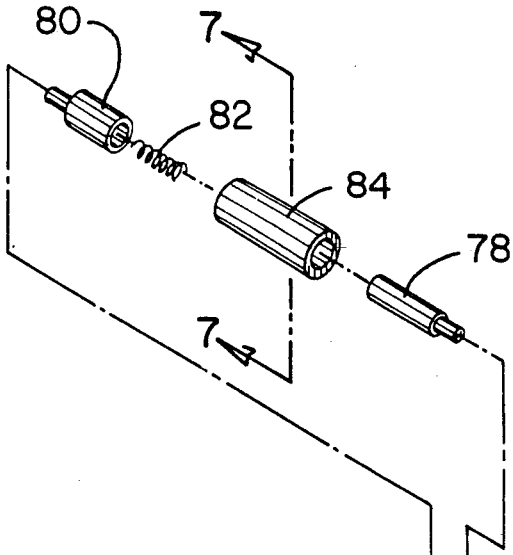
FIG. 7 is a cross-sectional view taken along line 7—7 of FIG. 5.
Figure 7:
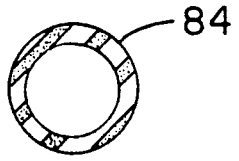
Figure 5:
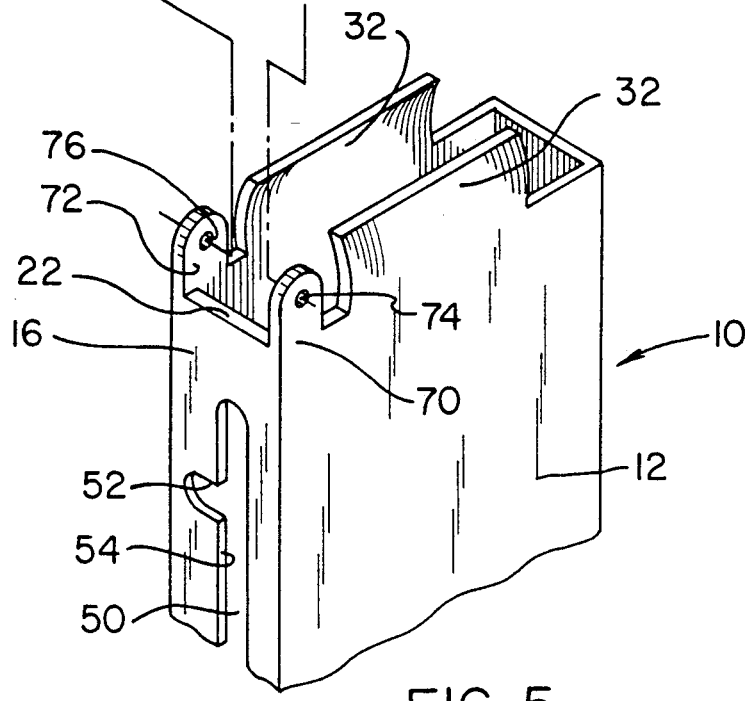
FIG. 5 is an exploded assembly view in perspective of an alternatively preferred embodiment of the invention.
Figure 6:
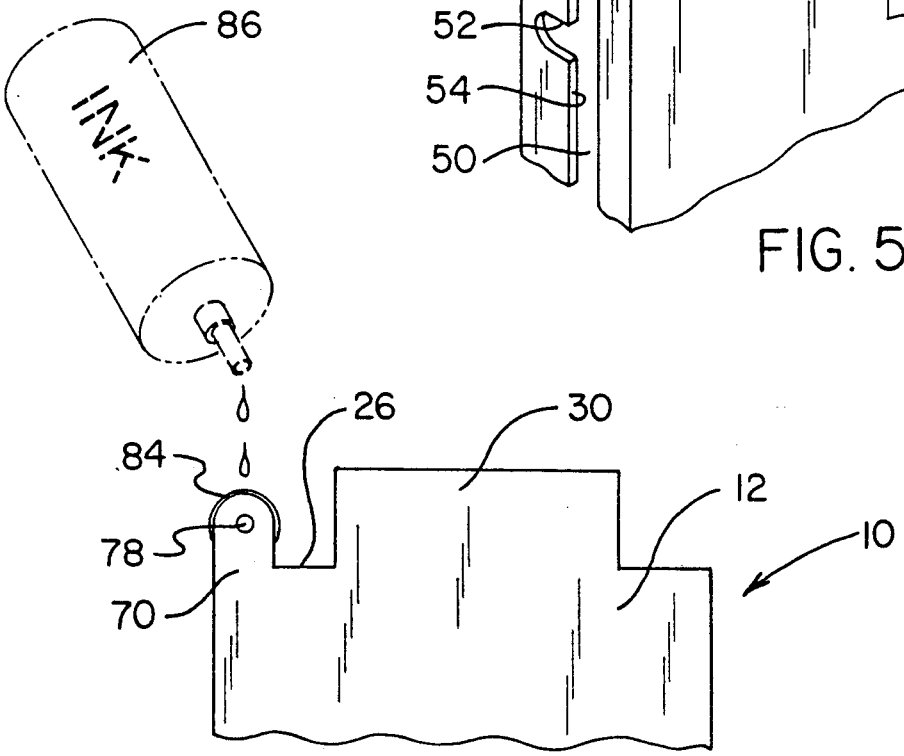
FIG. 6 is a front view of the upper portion of the alternatively preferred embodiment of the cartridge magazine of the invention shown in FIG. 5.

Turning initially to FIGS. 1–4, there is shown a first exemplary embodiment of the cartridge magazine designated by reference numeral 10. In its preferred form, cartridge magazine 10 comprises generally a rectangularly shaped magazine or clip housing having front and rear opposed side walls 12, 14; opposed front and rear end walls 16, 18; and a flanged bottom wall 20. The top of the magazine is open with the end walls terminating in aligned edges 22, 24 and with the edges 26, 28 of the side walls being interrupted by upstanding opposed arcuate tangs 30, 32 substantially as shown. Disposed interiorly of the magazine 10 is an elevator generally designated by reference numeral 34 suitably attached to one end of a fan-foldable flat ribbon spring 36 whose other end is suitably attached to the inside surface of bottom wall 20 as depicted in FIG. 3. Elevator 34 has a bottom generally rectangularly shaped portion 38 having a longitudinally extending channel 40 in the downwardly facing surface thereof for receiving the top end of spring 36. The spring top end preferably is seated in channel 40 and attached to the portion 38 by a suitable fastener (not shown) to securely affix the elevator on spring 36. The elevator further includes a flared upper portion 42 integral with bottom portion to serve as a platform or supporting surface for a multiplicity of cartridge shells or bullets stacked one on top of the other thereon through the open end of the magazine. It will be noted in FIGS. 3 and 4 especially, that the flared portion 42 extends substantially the full transverse extent of magazine's interior and is bounded by flat end walls 44, 46. It will be appreciated that when a cartridge shell or a series of shells is positioned on elevator 34, spring 36 urges the elevator and the shell(s) upward as viewed in FIG. 3 so that the top shell is constrained by arcuate tangs 32, 34 and the rear of the shell i.e. its firing pin, is adjacent to and above edge 22 of end wall 16, and thus when the magazine is inserted into a suitable firearm (indicated by broken lines in FIG. 1), the topmost bullet in the magazine will be in firing position.

In accordance with the present invention, end wall 16 includes a longitudinal main slot 50 having a series of longitudinally spaced notches or side slots each designated by reference numeral 52 opening into main slot 50 as seen to best advantage in FIGS. 2 and 3. The leftmost longitudinal edge 54 of main slot 50 is positioned substantially centrally of end wall 16 and serves as a guide edge for a key 56 adapted to be inserted through main slot 50 and seated in a blind hole or recess 58 located in end edge 44 extending axially or longitudinally in portion 38 of elevator 34. Key 56 has a loop 60 at one end thereof and a pin 62 at the other opposed end thereof with the loop being large enough to receive the thumb of a user and with the diameter of pin 62 being sized suitably to slidably, but frictionally fit securely in blind hole 58 when inserted therein. In addition, the axial extent or length of pin 62 is such as to engage notches 52 when the key is inserted into hole 58 and frictionally retained therein.

It will be apparent that by virtue of the above arrangement, the pin 62 of key 56 may be inserted through the main slot 50 into hole 58 of elevator portion 38 and used to move the elevator downward against the force of spring 36 with the pin member slidably engaging guide edge 54 defined by main slot 50. When the pin is aligned with a branch notch or slot 52, a slight left-ward movement of the key 56 urges the pin 62 laterally into the slot thereby locking the elevator into position. Bullets may then easily be inserted into the magazine through its open top end until there is no more room in the magazine. The key 56 then is moved slightly to the right into main slot 50, releasing the elevator and enabling further movement thereof downwardly to the next lower branch slot to again lock the elevator in position as described. By successive use of the key 56 and the branch slots 52 a predetermined quantity of bullets may easily be loaded onto the elevator in the clip 10 without having to overcome the increasing spring resistance of spring 36 as the elevator is moved in stages lower and lower toward bottom wall 20. In this regard, it is to be noted that, if desired, the user may skip over one or more of the branch slots 52 as the elevator is moved downwardly in the clip and temporarily locked into position for easy loading of cartridge shells therein in accordance with the present invention.

In order to permit the slight lateral movement of the elevator inside the interior cavity of clip 10 sufficient to enable engagement of pin 62 with slot 50 and slot 52, the elevator is made slightly undersized with respect to the transverse cross-sectional dimensions of the magazine as will obviously occur to the routineer. Moreover, it is to be understood that the axial spacing between branch notches or slots 52 is chosen to be generally equal to a predetermined number of shells to be loaded for each locked position of the elevator. In the preferred arrangement, depending upon caliber, the mostly desired axial spacing between notches 52 will permit approximately five shells to be loaded before it is necessary to unlock and index the elevator to the next lower position defined by the next lower branch notch 52.

An important advantage of the novel cartridge magazine of the present invention as described above is the easy manner in which the loading of shells into the magazine is facilitated. As a result of the disposition of parts described above, the magazine clip 10 may be held in one hand with the palm of the hand engaging bottom wall 20 and with the thumb on that hand engaging loop 60 of key 56. By squeezing the thumb downwardly, the elevator may be caused to descend against resistance afforded by spring 36 and locked into the position desired via selected slots 52. The other or free hand may then be used to drop cartridges or bullets into the open end of the magazine and the process repeated until the clip is completely loaded. The key 56 may then be removed from its engagement with elevator 34, and the clip inserted into the firearm with which it is used.

Turning now to FIGS. 5 through 8 there is shown an alternatively preferred embodiment of the cartridge magazine of the invention wherein like reference numerals represent like parts. In this modified exemplary form of the invention, means are provided for placing a marking on the rear or firing pin face of each shell as it is ejected from the magazine into the firing chamber of the firearm. Such means comprise an ink roller 84 mounted for rotation on a pair of upstanding ears 74, 76 positioned proximal to edge 22 of end wall 16 substantially as shown. The ink roller is mounted for rotation on a pair of bushings 78, 80 having suitable reduced diameter ends for respectively engaging holes 74, 76 in ears 70, 72 via the axial urging of coil spring 82 in a manner believed apparent. Ink roller 86 may periodically be replenished with a fresh supply of ink represented generally by container 86. By use of such marking means, the identification of a particular user's spent shell casings may rapidly be facilitated.

Figure 8:
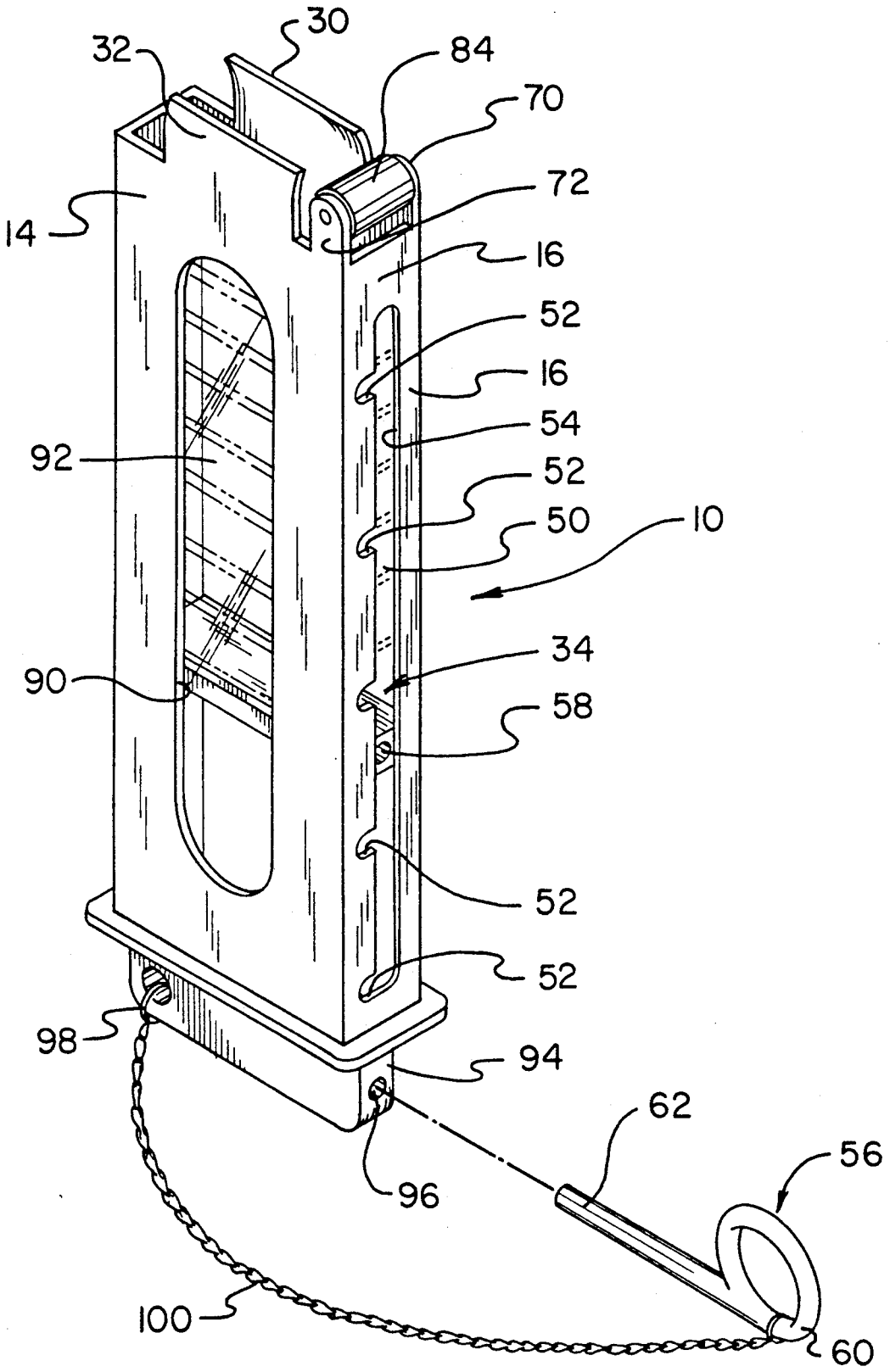
FIG. 8 is a perspective elevational view of the alternatively preferred embodiment of the cartridge magazine of the invention.

In addition, as substantially shown in FIG. 8, the modified version of the cartridge magazine includes a key holder 94 having a blind hole 96 for axially receiving slidably and frictionally the free end of pin 62 of key 56, which holder 94 is affixed in a suitable manner to the bottom outwardly facing surface of flanged bottom wall 20. A flexible link chain 100 having one end suitably fastened to the holder 94 via rear through hole 98 and the other end suitably fastened to the loop 60 of key 56 conveniently provides means for attaching the key to the magazine and storing it when the magazine is inserted into the firearm being employed thus assuring that the key 56 always will be available.

Finally, a cutout 90 and a suitable transparent window 92 in one or both of the sidewalls of the magazine (e.g. sidewall 14) is preferably employed substantially as shown to permit the user to view the number and orientation of shells already loaded onto elevator 34 and/or the position of the elevator at any given moment.

From the foregoing it should be apparent that new and improved cartridge magazine of the present invention is capable of facilitating the loading of shells therein in a simple and rapid manner.

With respect to the above description, it should be realized that the magazine 10 may be sized for any particular caliber of shell or cartridge. Accordingly, the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein. Hence, the proper scope of the present invention should be determined only by the broadest interpretation of the appended claims so as to include such modifications and/or alterations.

What is claimed as being new and desired to be protected by Letters Patent of the United States is as follows:

1. A new and improved cartridge magazine for a firearm comprising in combination:

a housing, said housing having first and second opposed end walls, first and second opposed side walls, a bottom wall and a top end opening, said housing defining an interior cavity for storing a multiplicity of cartridge shells one on top of the other with the longitudinal axis of each cartridge shell being substantially orthogonal to the longitudinal extent of said housing, said first end wall having a slot therein extending longitudinally between said top end and said bottom wall, said slot having at least one notch laterally extending from said slot in the plane of said end wall intermedially of the longitudinal extent of said slot, elevator means disposed in said cavity for longitudinal movement therein, said elevator means having an end face confronting said slot in said first end wall and key receiving means in said end face, resilient means in said cavity between said bottom wall and said elevator means for urging said elevator means toward said top end opening, and key means for selective insertion into said key receiving means through said slot to engage said end face of said elevator whereby movement of said key enables movement of said elevator in said cavity and selective engagement of said key with said slot in said end wall and said at least one notch laterally extending from said slot, said key means further comprising a loop at one end thereof for engagement by the thumb of a user's hand when said bottom wall of said housing is resting in the palm of said user's hand with said housing in an upright position.

2. The invention of claim 1 wherein said slot includes a multiplicity of notches laterally extending from said slot in the plane of said end wall, said notches being spaced longitudinally from each other.

3. The invention of claim 1 wherein the other end of said key comprises a pin member, said elevator end face includes a recess therein, said pin member adapted to be slidably inserted into said recess and frictionally engaged therein.

4. The invention of claim 3 wherein said pin member has an axial extent sufficient to enable said pin member to engage said at least one notch when said key means pin member is frictionally engaged in said recess in said elevator end face.

5. The invention of claim 1 further including marking means for placing an identifying marking on the end face of each cartridge shell stored in said housing when said cartridge shell is ejected from said housing, said marking means being disposed on said housing proximal to said top end opening.

6. The invention of claim 1 further including key retaining means supported on the bottom end wall of said housing, and flexible means for attaching said key means to said key retainer means.

7. The invention of claim 1 wherein at least one of said side walls includes window means therein for viewing the position of said elevator means in said cavity.

8. The invention of claim 2 wherein the axial spacing between said notches is equal to the stacking height of a predetermined number of said cartridge shells.

* * * * *